US005566389A

United States Patent [19]

Li

[11] Patent Number: 5,566,389

[45] Date of Patent: Oct. 22, 1996

[54] SHOCK ABSORBING WRIST GUARD

[76] Inventor: Kao-ming Li, No. 1-14, Ma Tou Kou, Ma Kou Li, Ma Tou Chen, Tainan Hsien, Taiwan

[21] Appl. No.: 486,134

[22] Filed: Jun. 6, 1995

[51] Int. Cl.[6] ..... A41D 13/08

[52] U.S. Cl. ..... 2/16; 2/161.1; 2/162

[58] Field of Search ..... 2/16, 20, 161.1, 2/162; 473/62; 602/21

[56] References Cited

U.S. PATENT DOCUMENTS

| | | | |
|---|---|---|---|
| 3,496,573 | 2/1970 | Kucher et al. | 2/16 X |
| 5,313,667 | 5/1994 | Levine | 2/16 |
| 5,330,391 | 7/1994 | Mitchell | 2/16 X |
| 5,339,465 | 8/1994 | Kyewski | 2/20 |
| 5,435,007 | 7/1995 | Kalvestran et al. | 2/16 |
| 5,445,566 | 8/1995 | Hayes | 2/161.1 X |

*Primary Examiner*—Paul C. Lewis

*Attorney, Agent, or Firm*—Kirkpatrick & Lockhart LLP

[57] ABSTRACT

A shock-absorbing wrist guard includes a soft piece including two ear portions, a loop pile area connected on a portion of the soft piece, an envelope connected to another portion of the soft piece and defining a plurality of slots therein, a mediate portion between the loop pile area and the envelope, an opening defined in the space portion allowing a thumb of a user to pass therethrough, and a soft strip extended from one side of the loop pile area, and a shock absorbing device received in the envelope for protecting the user's wrist. The shock-absorbing device includes a flat plate, two wings extended from the flat plate, an arcuate portion bridged above a portion of the flat plate which is located between the two wings, thus defining a space between the arcuate portion and the flat plate, a plurality of cushion elements being formed in the space and connected between the arcuate portion and the flat plate portion which is between the two wings for absorbing an external reactive force transmitted through the arcuate portion.

7 Claims, 7 Drawing Sheets

SHOCK ABSORBING WRIST GUARD

BACKGROUND OF THE INVENTION

1. Field of the Invention

The present invention relates to a shock-absorbing wrist guard for absorbing a shock, impact, or an equivalent especially one which has multi-support safety structure to protect a user.

2. Description of the Prior Art

Wrist guards which are used to protect a user's wrists are popular in many sports such as tennis, badminton, skiing, basketball etc. In FIGS. 8 and 9, a conventional wrist guard 30 is shown. The conventional wrist guard 30 comprises a soft piece 30A made of nylon or cloth which has two ear portions 33. This conventional wrist guard 30 comprises a loop pile area 34 stitched on a portion of the soft piece 30A, a leather envelope 35 stitched to another portion of the soft piece 30A and defining three slots 36 therein, a mediate portion 340 between the loop pile area 34 and the leather envelope 35, an opening 37 defined in the mediate portion 340 allowing a thumb (in this case for a left hand thumb) to pass therethrough, and a soft strip 31 extended from one side of the loop pile area 34. There are hook piles (not shown) formed on the two ears 33 for engaging to the loop pile area 34 when the two ears 33 are wound around a hand. The soft strip 31 is allowed to be wound around a hand for fixing the wrist guard on the hand. A hook pile area 32 is formed in the soft strip 31, therefore when the soft strip 31 is wound around a hand, the hook pile area 32 is connected to the loop pile area 34, thereby fixing the wrist guard on the hand. A protecting plate 40 made of hard plastic includes a first flat portion 41, a second flat portion 43, and an arcuate portion 42 connected between the first flat portion 41 and the second flat portion 43. The protecting plate 40 is engaged to the leather envelope 35 with the arcuate portion 42 exposed on an outer surface of the leather envelope 35 and the flat portions 41 and 43 received in the leather envelope 35. When the conventional wrist guard is worn on a hand, the arcuate portion 42 of the protecting plate 40 is substantially under a palm of the hand for protecting the user. However, this structure is not sufficient to protect the user when the user falls and the arcuate portion 42 receives a very strong impact from a hard surface such as when skiing very fast. Specifically, if a very strong reactive force is received from the ground to the protecting plate 40, the reactive force will be transmitted through the protecting plate 40 to hurt the wrist of the user.

It is requisite to provide a new wrist guard which can considerably reduce a reactive force thus protecting a user.

SUMMARY OF THE INVENTION

The primary objective of the present invention is to provide a shock-absorbing wrist guard for protecting a user's wrist from a strong reactive force.

In accordance with one aspect of the invention, there is provided a shock-absorbing wrist guard for absorbing a shock, impact, or an equivalent, including a soft piece including two ear portions, a loop pile area connected on a portion of the soft piece, an envelope connected to another portion of the soft piece and defining a plurality of slots therein, a mediate portion between the loop pile area and the envelope, an opening defined in the mediate portion allowing a thumb of a user to pass therethrough, and a soft strip extended from one side of the loop pile area, and a shock-absorbing means for absorbing a shock received in the envelope for protecting the user's wrist. The shock-absorbing means includes a flat plate, two wings extended from the flat plate, an arcuate portion bridged above a portion of the flat plate which is located between the two wings, thus defining a space region between the arcuate portion and the flat plate, a plurality of cushion elements being formed in the space region and connected between the arcuate portion and the flat plate portion which is between the two wings for absorbing an external reactive force transmitted through the arcuate portion Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
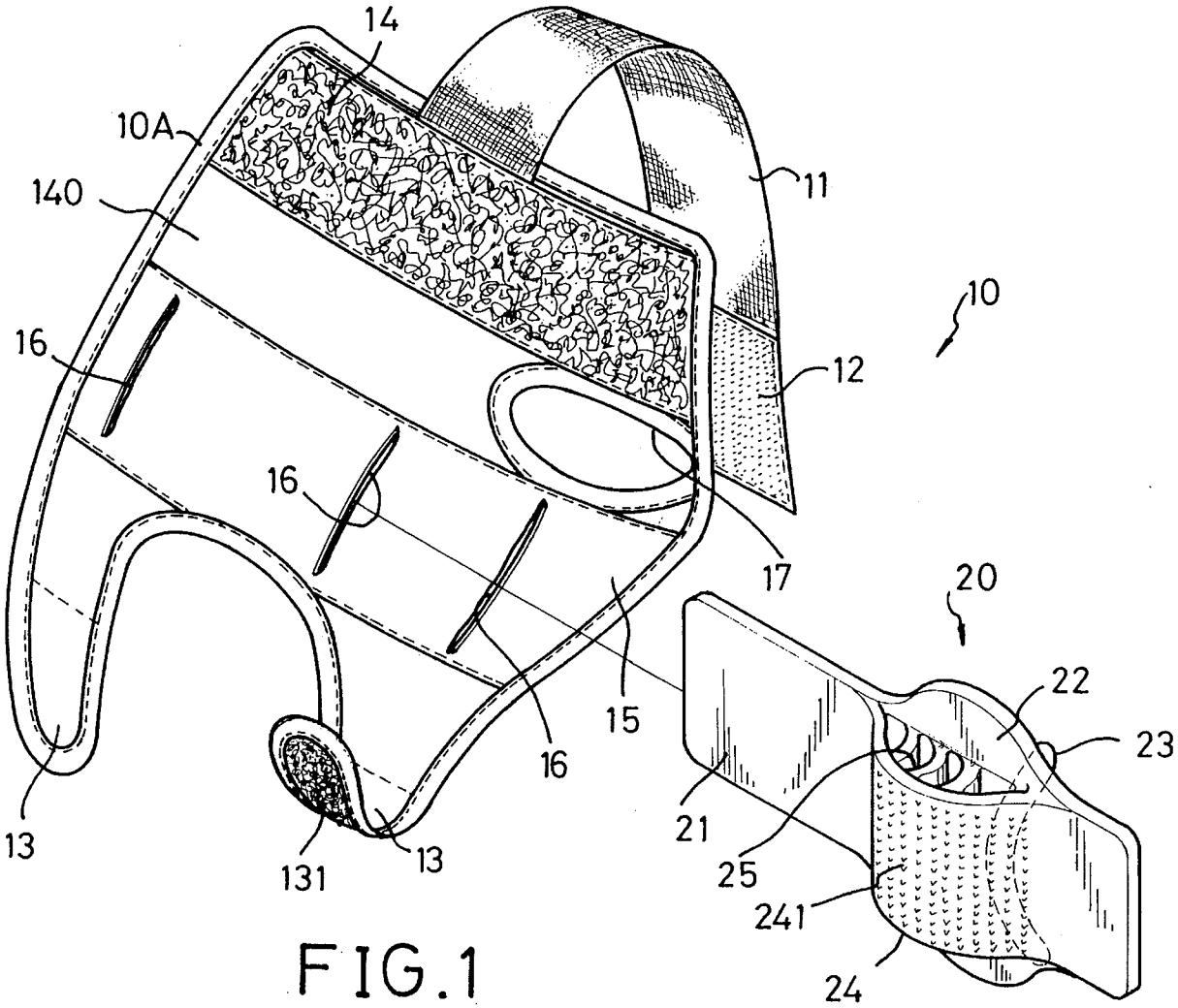
FIG. 1 is an exploded view of an absorbing wrist guard in accordance with the present invention.
Figure 2:
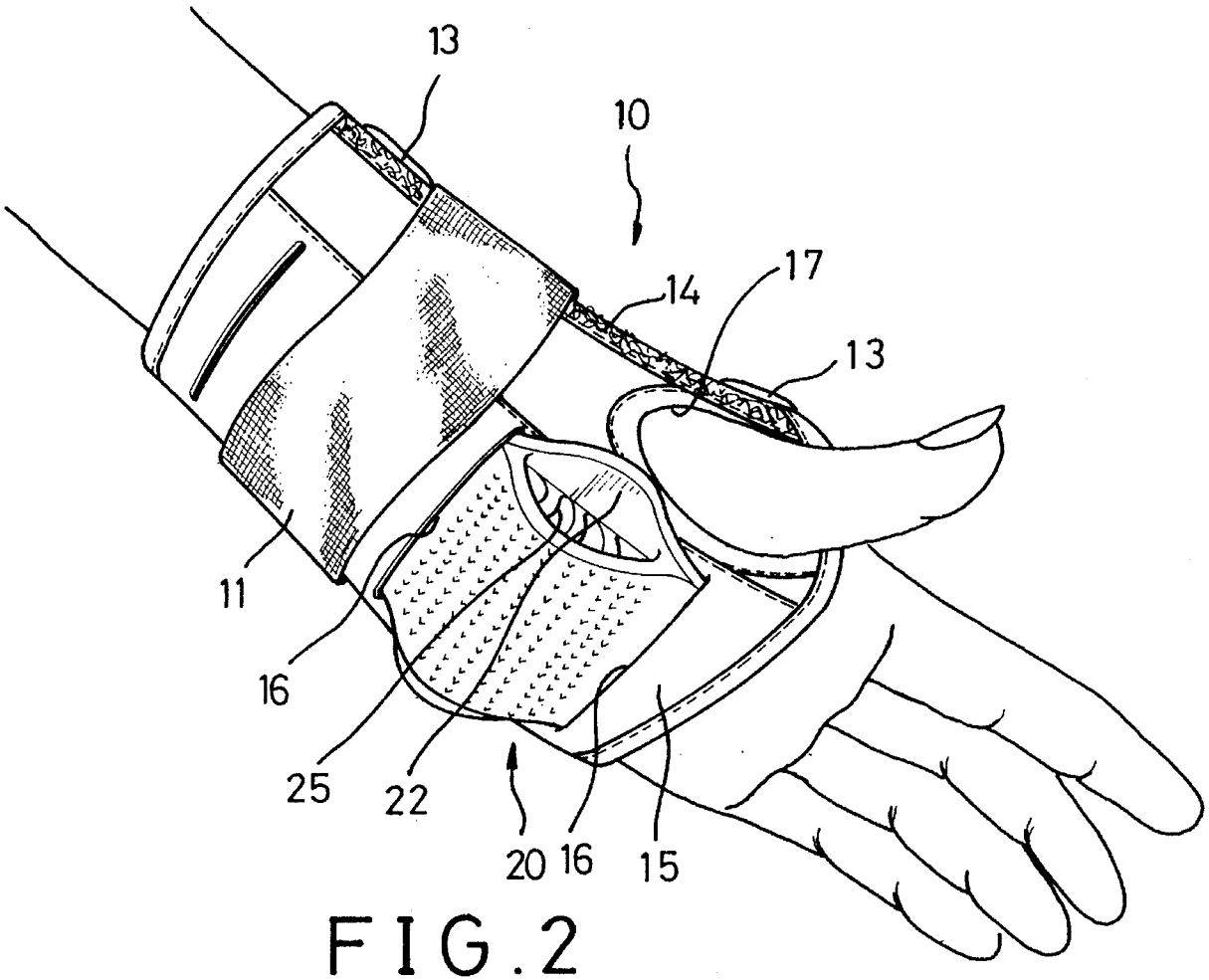
FIG. 2 is view illustrating that the shock-absorbing wrist guard of 1 is assembled and worn on a hand.
Figure 3:
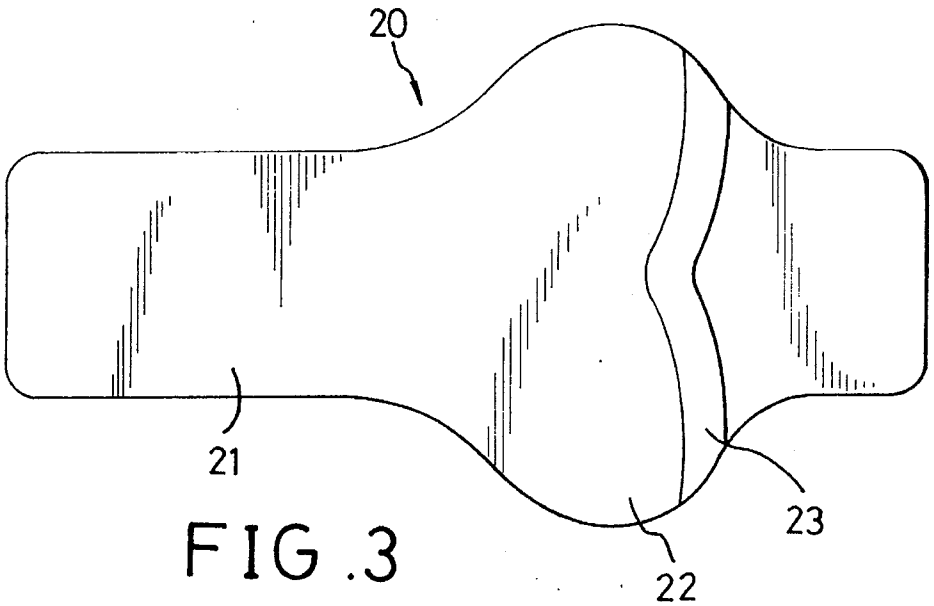
FIG. 3 is a top view of a shock-absorbing means of the shock-absorbing wrist guard of the present invention.

Referring to the drawings, and initially to FIG. 1, a shock-absorbing wrist guard 10 in accordance with the present invention comprises a piece 10A made of nylon or cloth which has two ear portions 13, a loop pile area 14 stitched on a portion of the soft piece 10A, a leather envelope 15 stitched to another portion of the soft piece 10A and defining three slots 16 therein, a mediate portion 140 between the loop pile area 14 and the leather envelope 15, an opening 17 defined in the mediate portion 140 allowing a thumb (in this case for a left hand thumb) to pass therethrough, and a soft strip 11 extended from one side of the loop pile area 14. There are hook piles 131 formed on the two ears 13 (only one is shown with the hook piles) for engaging to the loop pile area 14 when the two ears 13 are wound around a hand. The soft strip 11 is allowed to be wound around a hand for fixing the wrist guard 10 on the hand. A hook pile area 12 is formed on the soft strip 11, therefore when the soft strip 11 is wound around a hand, the hook pile area 12 is connected to the loop pile area 14, thereby fixing the wrist guard 10 on the hand as shown in FIG. 2. A shock-absorbing means 20 is received in the leather envelope 15 for protecting the user's wrist. The shock-absorbing means 20 comprises a flat plate 21, two wings 22 extended from the flat plate 21, an arcuate portion 24 bridged above a portion of the flat plate 21 Which is located between the two wings 22, thus defining a space (not labeled) between the arcuate portion 24 and the flat plate 21. A plurality of cushion elements such as curved ribs 25 are formed in the space and connected between the arcuate portion 24 and the flat plate portion which is between the two wings 22 for absorbing an external reactive force transmitted through the arcuate portion 24. The arcuate portion 24 includes a plurality of protrusions 241 formed on a surface thereof for increasing resistance when the wrist guard 10 is impacted against a hard surface such as the ground. An arcuate rib 23 as shown in FIG. 3 is formed on an opposite surface to the curved ribs 25 of the flat plate 21 substantially across the two wings 22 for strengthening the flat plate 21. Each of the curved ribs 25 are made with varying thicknesses along an elongated direction thereof for increasing deformation thereof when receiving an impact. The flat plate 21, the two wings 22, the arcuate portion 24, and the curved ribs 25 are made of elastic rubbers for absorbing a reactive force. Therefore, the shock-absorbing means 20 can provide a multi-support safety structure including the flat plate 21, the two wings 22, the arcuate portion 24, and the curved ribs 25 to protect a user.

Figure 7:
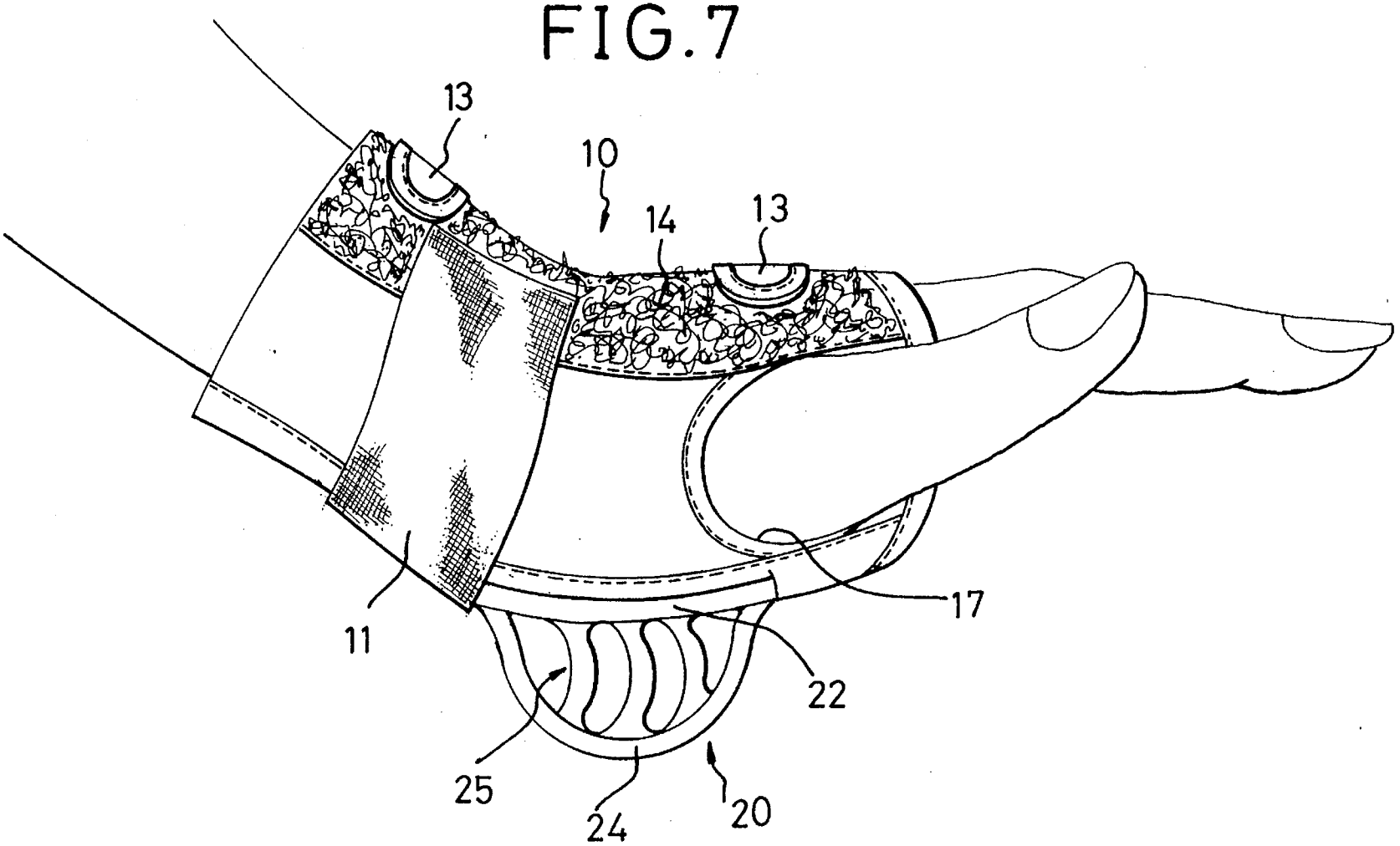
FIG. 7 is a side view showing the shock-absorbing wrist guard of the present invention being worn on a hand.
Figure 8:
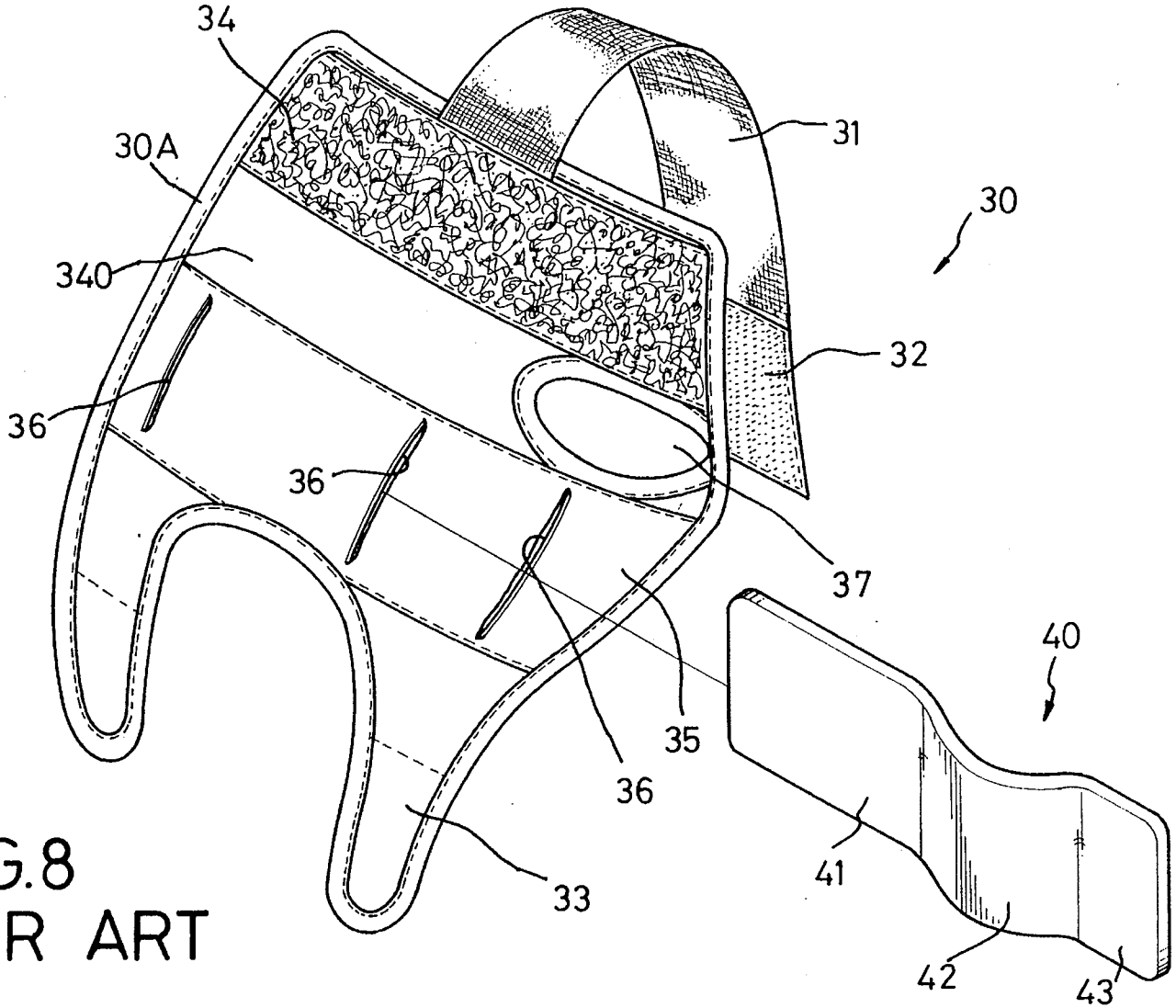
FIG.8 PRIOR ART
FIG. 8 is a conventional wrist guard shown in an exploded view.
Figure 9:
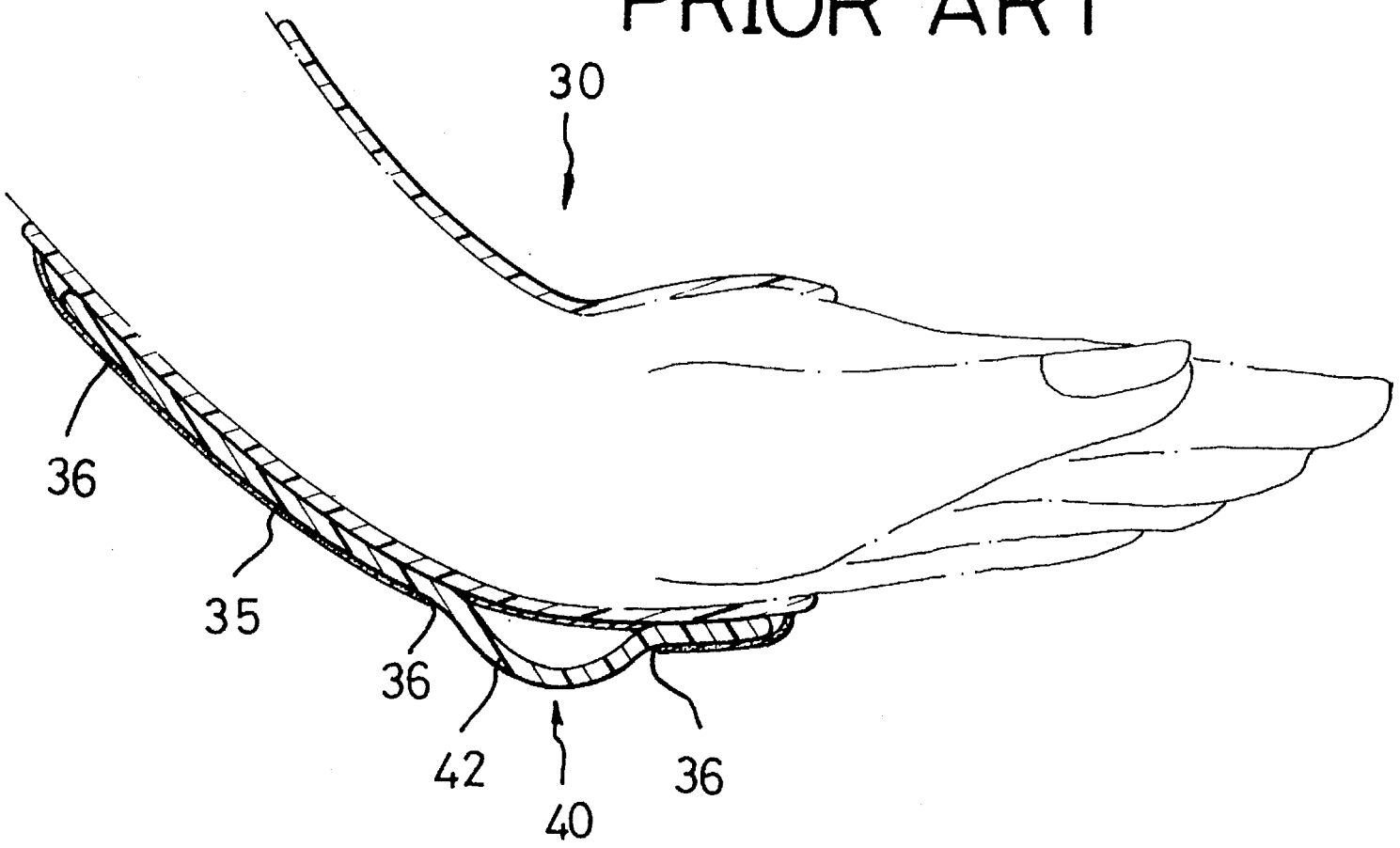
FIG. 9 PRIOR ART
FIG. 9 illustrates the conventional wrist guard being worn on a hand.

Referring to FIGS. 2 and 7, the wrist guard 10 of the present invention is assembled and worn on a user's hand, where the shock-absorbing means 20 is engaged to the leather envelope 15 with the arcuate portion 24 exposed on an outer surface of the leather envelope 15 and two ends of the flat plate 21 are received in the leather envelope 15. When the wrist guard 10 is worn on a hand, the arcuate portion 24 of the shock-absorbing means 20 is substantially under the palm of the hand for protecting the user. The curved ribs 25 deform when they can not resist a reactive force thus considerably reducing the reactive force to the wrist of the user. The extended wings 22 beside the flat plate 21 can distribute the remaining reactive force for protecting the user's wrist.

Figure 4:
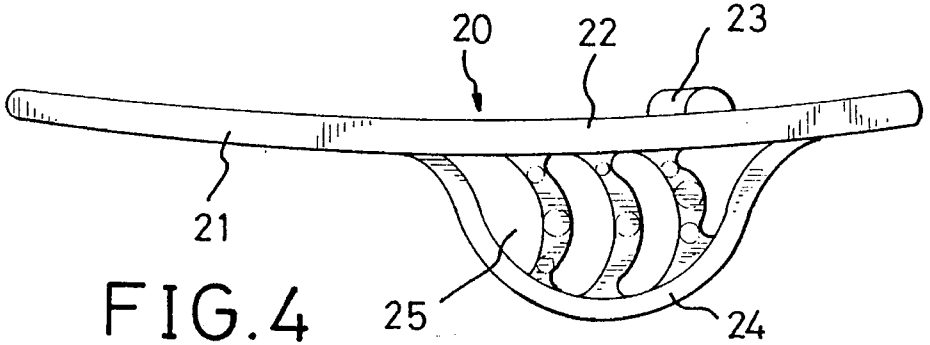
FIG. 4 is a side view of a shock-absorbing means of the shock-absorbing wrist guard of the present invention.
Figure 5:
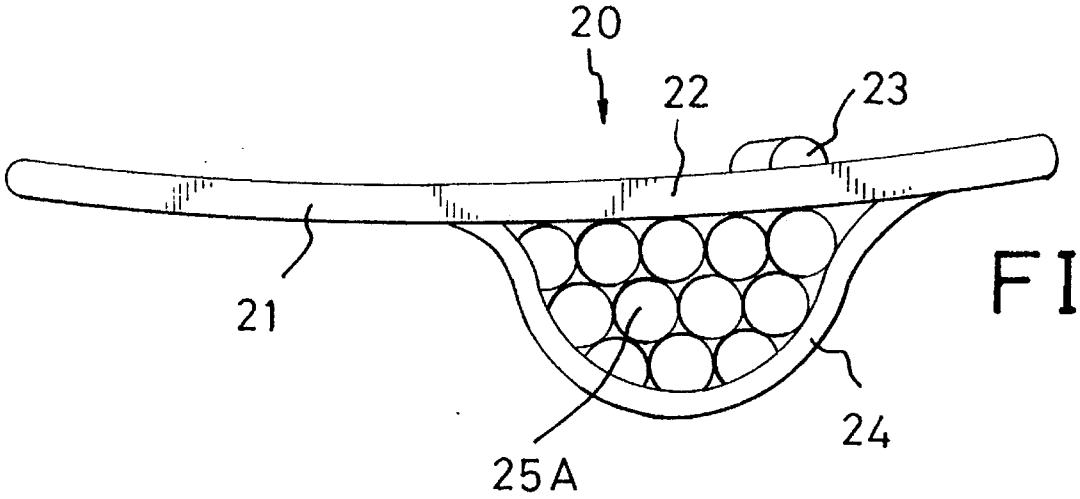
FIG. 5 is a side view of a shock-absorbing means of a second embodiment of the shock-absorbing wrist guard of the present invention.
Figure 6:
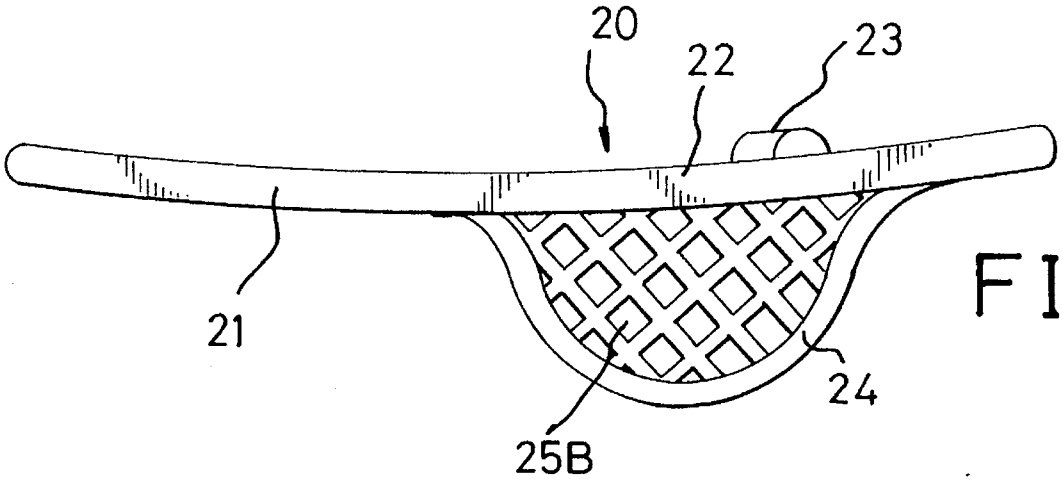
FIG. 6 is a side view of a shock-absorbing means of a third embodiment of the shock-absorbing wrist guard of the present invention.

The cushion elements such as the curved ribs 25 in FIG. 4 can be replaced with other structures such as sponges 25A as shown in FIG. 5 or grids 25B as shown in FIG. 6. Referring to FIG. 5, the sponges 25A are connected between the arcuate portion 24 and the flat plate portion 21 which is between the two wings 22. Referring to FIG. 6, the grids 25B are connected between the arcuate portion 24 and the flat plate portion 21 which is between the two wings 22. The sponges 25A and the grids 25B are made of elastic rubbers or other materials which can receive an external force. It is noted that the sponge structure 25A and the grid structure 25B can absorb the reactive force with the same efficiency as the curve ribs 25 of FIG. 4.

I claim:

1. A shock-absorbing wrist guard for absorbing a shock, comprising a soft piece including two ear portions, a loop pile area connected on a portion of the soft piece, an envelope connected to another portion of the soft piece and defining a plurality of slots therein, a mediate portion between the loop pile area and the envelope, an opening defined in the mediate portion allowing a thumb of a user to pass therethrough, and a soft strip extended from one side of the loop pile area characterized in that a shock-absorbing means for absorbing a shock is received in the envelope for protecting the user's wrist, the shock-absorbing means comprising a flat plate, two wings extended from the flat plate, an arcuate portion bridged above a portion of the flat plate which is located between the two wings, thus defining a space region between the arcuate portion and the flat plate portion, a plurality of cushion elements being formed in the space region and connected between the arcuate portion and the flat plate portion which is between the two wings for absorbing an external reactive force transmitted through the arcuate portion.

2. A shock-absorbing wrist guard as claimed in claim 1 further comprising a plurality of protrusions formed on a surface of the arcuate portion for increasing resistance when the wrist guard is impacted against a hard surface.

3. A shock-absorbing wrist guard as claimed in claim 1 further comprising an arcuate rib formed on an opposite surface to the cushion elements of the flat plate substantially across the two wings for strengthening the flat plate.

4. A shock-absorbing wrist guard as claimed in claim 1 wherein each of the cushion element is made with varying thicknesses for increasing deformation thereof when receiving a reactive force.

5. A shock-absorbing wrist guard as claimed in claim 1, wherein the cushion elements are a plurality of curved ribs formed in the space and connected between the arcuate portion and the flat plate portion which is between the two wings.

6. A shock-absorbing wrist guard as claimed in claim 1, wherein the cushion elements are a plurality of sponges formed in the space and connected between the arcuate portion and the flat plate portion which is between the two wings.

7. A shock-absorbing wrist guard as claimed in claim 1, wherein the cushion elements are a plurality of grids formed in the space and connected between the arcuate portion and the flat portion which is between the two wings.

* * * * *